US006450278B1

(12) United States Patent
Shirogami et al.

(10) Patent No.: US 6,450,278 B1
(45) Date of Patent: Sep. 17, 2002

(54) CONSTRUCTION MACHINE WITH A DUCT FOR HYDRAULIC HOSES

(75) Inventors: Tadashi Shirogami; Tomohiko Ochi; Tokuo Fujii, all of Hiroshima (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 0 days.

(21) Appl. No.: 09/631,302

(22) Filed: Aug. 2, 2000

(30) Foreign Application Priority Data

Aug. 3, 1999 (JP) ..... 11-219985

(51) Int. Cl.[7] ..... B62D 25/10; B60K 26/00; E02F 9/16

(52) U.S. Cl. ..... 180/69.21; 180/315; 180/329; 180/334; 180/89.18

(58) Field of Search ..... 180/315, 326, 180/329, 331, 334, 89.18, 89.14, 69.21

(56) References Cited

U.S. PATENT DOCUMENTS

| | | | | |
|---|---|---|---|---|
| 2,635,582 A | | 4/1953 | Zeilman | |
| 4,055,230 A | * | 10/1977 | Kestian et al. | 180/89.1 |
| 4,057,122 A | * | 11/1977 | Brownell et al. | 180/329 |
| 4,312,418 A | | 1/1982 | Rittman | |
| 4,506,750 A | * | 3/1985 | Leskovec | 180/329 |
| 5,016,722 A | * | 5/1991 | Morita et al. | 180/89.14 |

FOREIGN PATENT DOCUMENTS

| | | |
|---|---|---|
| DE | 196 46 039 | 5/1998 |
| FR | 2 544 973 | * 11/1984 |
| GB | 2 046 676 | 11/1980 |
| GB | 2 224 559 | 5/1990 |

* cited by examiner

*Primary Examiner*—Peter C. English
(74) *Attorney, Agent, or Firm*—Oblon, Spivak, McClelland, Maier & Neustadt, P.C.

(57) ABSTRACT

A construction machine including a maneuvering seat on which an operator sits, a guard cover for supporting the maneuvering seat thereon, and a control box arranged on one side of the maneuvering seat. The control box having a control valve and an operating lever for operating the control valve. The control box turning about a turning fulcrum so as to facilitate getting on and off when an operator gets on and off from the maneuvering seat. The construction machine further including hydraulic hoses which hang from the control valve and are pulled out of the control box. The hydraulic hoses having bent portions externally of the control box, the bent portions being displaced when the control box turns to absorb the up and down movement of the hydraulic hoses. Accordingly, the up and down movement of the hydraulic hoses caused when the control box is forced up is absorbed by bent portions provided externally of the control box.

7 Claims, 5 Drawing Sheets

CONSTRUCTION MACHINE WITH A DUCT FOR HYDRAULIC HOSES

BACKGROUND OF THE INVENTION

1. Field of the Invention

The present invention relates to a construction machine such as a hydraulic excavator.

2. Description of the Related Art

In a conventional hydraulic excavator shown in FIG. 5, when a control box revolving lever 51 provided on the left hand at the lower part at the foot of a maneuvering seat 50 is pulled in a direction of arrow A, a control box 52 rotates in a direction of arrow B about a turning fulcrum 53. This facilitates up and down movement, and all the oil pressure is locked to prevent erroneous operation at the time of up and down movement.

In the construction machine provided with the jump-up control box 52 as described above, a plurality of pilot hoses 55 extending from a remote control valve 54 to a control valve are moved up and down with the jump-up operation. For the purpose of absorbing the up and down movement thereof, the pilot hoses 55 are positioned to the rear of the control box 52 and the turning fulcrum 53 is bypassed by the pilot hoses 55 which are substantially U-shaped.

In the pilot hose piping as described above, it is necessary that a plurality of hoses are forcibly pulled out rearward through an elbow 56 from the remote control valve 54 and moved around within the control box 52 while paying attention to an interference with other devices within the control box 52. Accordingly, there poses a problem in that it is difficult to install the pilot hoses 55 and it takes time to install them.

SUMMARY OF THE INVENTION

It is an object of the present invention to provide a construction machine for simplifying an installation of pilot hoses in case of being provided with a jump-up control box.

The construction machine according to the present invention comprises a maneuvering seat on which an operator sits, a guard cover for supporting the maneuvering seat thereon, a control box arranged on one side of the maneuvering seat, comprising a control valve and an operating lever for operating said control valve, and turning about a turning fulcrum so as to facilitate getting on to and off from the maneuvering seat for an operator, and hydraulic hoses which hang from said control valve and are pulled out of the control box, said hydraulic hoses having a bent portion externally of the control box, said bent portion being displaced when the control box turns to absorb up and down movement of the hydraulic hoses.

According to the above-described constitution, the up and down movement of the hydraulic hoses caused by jumping up of the control box is absorbed by the bent portion provided externally of the control box.

Further, according to the present invention, the hydraulic hoses may pass through forward of the turning fulcrum of the control box.

According to the above-described constitution, since the hydraulic hoses extending from the control valve are not necessary to bypass the turning fulcrum positioned at the rear of the control box as in prior art, installing of a hydraulic pipeline can be carried out in a short period of time and is simple.

Further, the present invention may further comprise a duct provided internally of the guard cover, which receives the hydraulic hoses with a play, and an L-shaped bent portion formed in the duct for maintaining the shape of said bent portion of the hydraulic hoses.

According to the above-described constitution, the hydraulic hoses are received within the duct having an L-shaped bent portion with a play, this protecting the hydraulic hoses. The duct holds the bent shape of the hydraulic hoses when the control box is in a normal position, and displaces the hydraulic hoses within the duct to absorb the up and down movement thereof when the control box is jumped up.

Further, according to the present invention, the duct may be mounted so as to be along the front surface of the guard cover positioned below the maneuvering seat.

According to the above-described constitution, since it is designed so that the duct may be mounted parallel with the front surface of the guard cover, there is no possible interference with other devices within the guard cover, and the installing work of the hydraulic hoses can be carried out simply.

Further, the front surface of the guard cover may be detachable. In this case, the maintenance of the hydraulic hoses or the like can be carried out easily, The duct is molded into a U-shape, and the hydraulic hoses extended from the other side of the maneuvering seat may be received into the duct. Further, the hydraulic hoses on one side and the hydraulic hoses on the other side may be gathered in the center of the duct, and pulled out of an opening formed in the central portion at the lower part of the duct.

Further, it may be also designed that a top plate of the guard cover is turned forward and opened with a front edge portion of the guard cover being a fulcrum, and also when the top plate turns, the bent portion is displaced to absorb the up and down movement of the hydraulic hoses.

DESCRIPTION OF THE PREFERRED EMBODIMENTS

Figure 1:
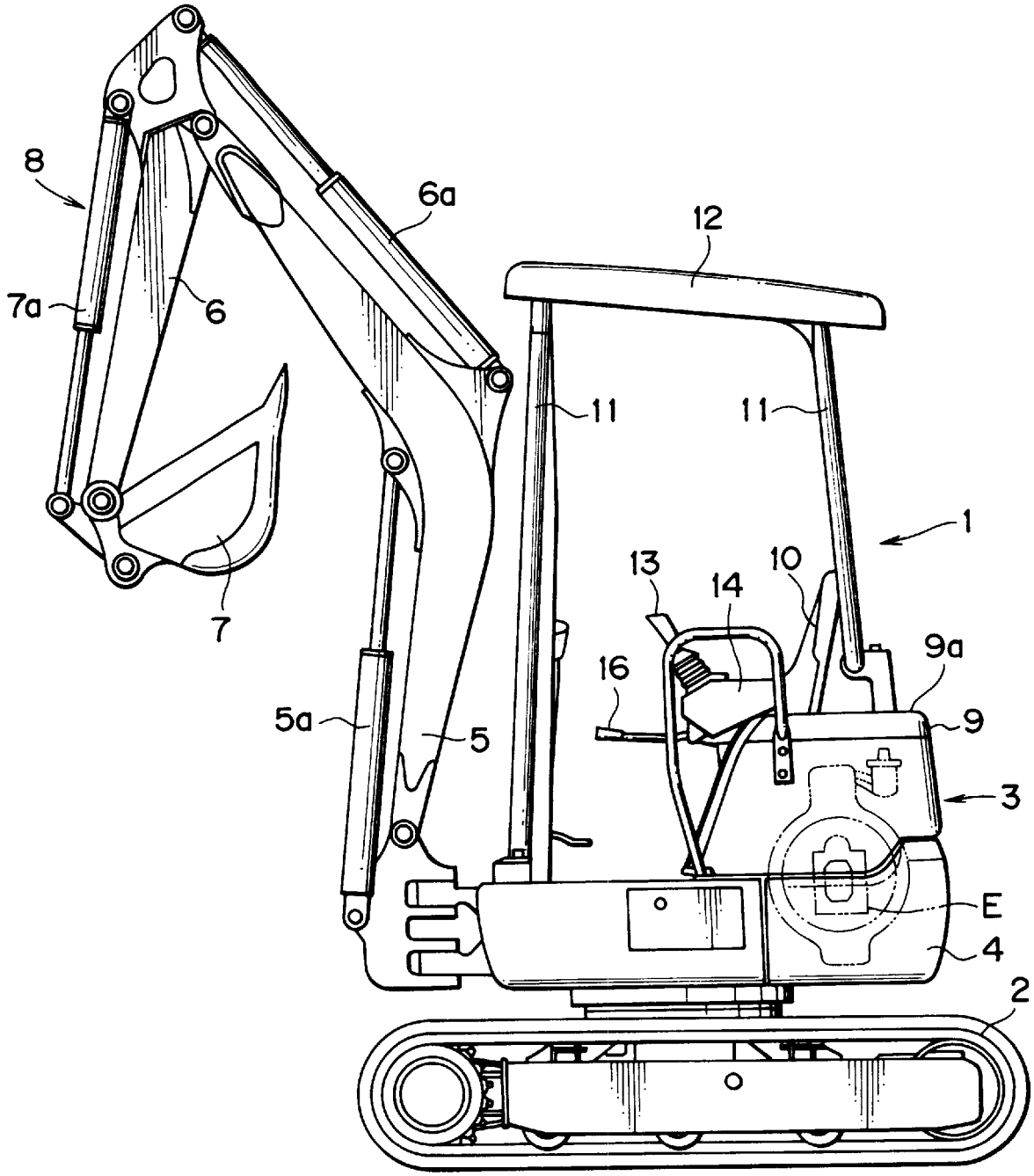
FIG. 1 is a front view showing the entire constitution of a construction machine according to the present invention.

The present invention will be described in detail on the basis of the embodiments shown in the drawings.

FIG. 1 shows the entire constitution of a hydraulic excavator as a construction machine according to the present invention. In the figure, a hydraulic excavator 1 has a small swing radius type upper turning body 3 mounted to be turned on the lower traveling body 2. In the front of a turning frame 4 of the upper turning body 3 is provided an excavating attachment 8 comprising a boom 5 driven by a boom cylinder 5*a*, an arm 6 driven by an arm cylinder 6*a*, and a bucket 7 driven by a bucket cylinder 7*a*.

On the other hand, a guard cover 9 is arranged at the rear of the turning frame 4. Received in the guard cover 9 are an engine E, a cooling system, an exhaust system, hydraulic devices and so on, which are not shown. A maneuvering seat 10 is secured to a top plate portion 9*a* of the guard cover 9. An operator sat on the maneuvering seat 10 is protected by a canopy 12 supported by a plurality of pillars 11. Numeral 13 designates an operating lever arranged on the left side of the maneuvering seat 10 (on the side where an operator gets on and off).

Figure 2:
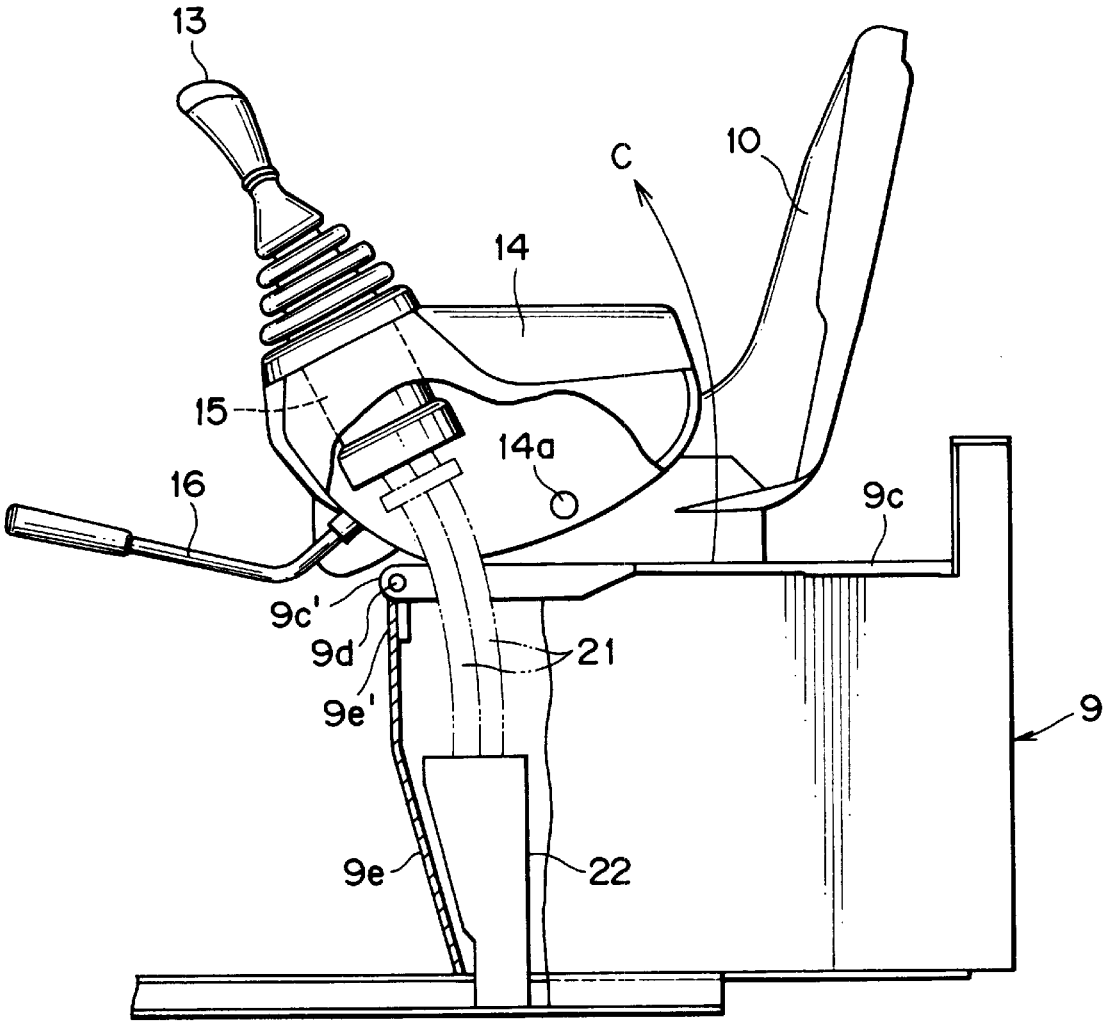
FIG. 2 is an enlarged view of a maneuvering seat portion of FIG. 1 having a portion of the control box cover removed.

FIG. 2 shows a portion of the maneuvering seat 10 in an enlarged scale. In the figure, numeral 9*c* designates a stand cover as a part of the top plate 9*a* of the guard cover 9. The maneuvering seat 10 is secured onto the stand cover 9*c*. The stand cover 9*c* comprises a substantially rectangular plate. Its front edge portion 9*c*' is connected to an upper edge portion 9*e*' of a guard cover front plate (front surface) 9*e* through a hinge 9*d*.

A control box 14 including an operating lever 13 is provided on the left side of the stand cover 9*c*. When the stand cover 9*c* is opened in a direction of arrow C, the stand cover 9*c* rotates about the hinge 9*d* as a fulcrum, and the control box 14 secured to the stand cover 9*c* rotates integrally. The stand cover 9*c* is opened forward mainly when the maintenance of the engine E takes place.

A plurality of pilot hoses (hydraulic hoses) 21 extending from a remote control valve (control valve) 15 operated by the operating lever 13 are hung and pulled out of the control box 14, and guided into a duct 22 provided within the guard cover 9.

Numeral 14*a* designates a turning fulcrum formed at the rear of the control box 14. Numeral 16 designates a control box revolving lever. When an operator gets on and off, he operates the lever 16 to force the control box 14 to jump up and backward about the turning fulcrum 14*a*.

Figure 3B:
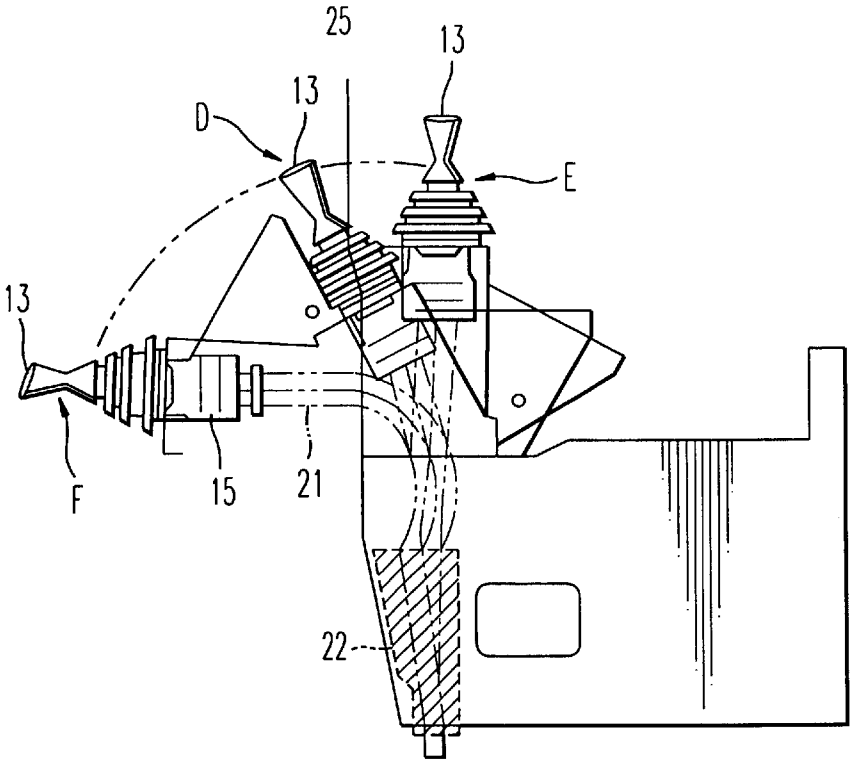
FIG. 3B is a left side view showing a control box having been forced up.

FIG. 3 shows a relation between the duct 22 and the pilot hoses 21 inserted therein. FIG. 3(*a*) shows a position of the operating lever when the control box 14 is in a normal position. FIG. 3(*b*) respectively shows a normal operating lever position (position D in the figure), an operating lever position when the control box is forced backward (position E in the figure), and an operating lever position when the control box is forced forward (position F in the figure).

Figure 3A:
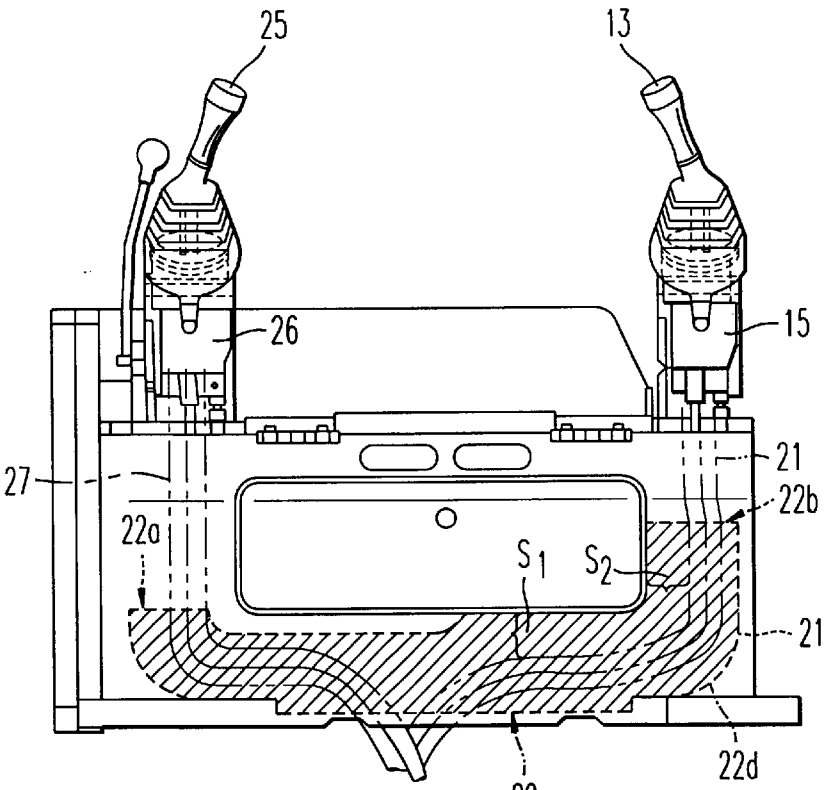
FIG. 3A is a front view showing an arrangement of a duct.

In FIG. 3A, the duct 22 comprises a resin-made tube molded into a U-shape. A pilot hose 27 extended from a remote control valve 26 operated by a right operating lever 26 is inserted into an opening 22*a* at the upper end of a longitudinal part of the duct on an operator's right side. The pilot hoses 21 extended from the remote control valve 15 are inserted into an opening 22*b* at the upper end positioned on the left side.

The pilot hoses 27 and 21 inserted from the openings 22*a* and 22*b* at the upper end of the duct 22 are gathered in the central portion of the duct 22 along the lateral part of the duct 22. They are pulled out of a laterally extending opening 22*c* formed in the central portion at the lower portion of the duct 22. The pulled out pilot hoses 27 and 21 are connected to a pilot port of a control valve (not shown) provided at a predetermined position on the turning frame 4.

FIGS. 4A to 4D show the shape of the duct 22 in detail. FIGS. 4A, 4B, 4C, and 4D respectively show a plan view, a left end view, a front view, and a right end view. In the figures, a lateral right part 22*d* of the duct 22 receives the pilot hoses 21, in which state, a play space S1 is formed vertically. Further, a longitudinal right part 22*e* also receives the pilot hoses 21, in which state, a play space S2 is formed horizontally.

On the other hand, a lateral left part 22*f* of the duct 22 receives the pilot hoses 27 in a state in which a play space smaller than play space S1 is formed. Because a remote control valve 26 operated by an operating lever 25 on the non-getting on and off side is fixed, so that the up and down movement of the pilot hoses 27 need not be considered. For example, where the control box on the operating lever 25 side also employs the jump-up constitution (in a longitudinal direction) for the reason that an auxiliary getting on and off entrance is provided or the control box is desired to be a certain predetermined size on the operating lever 25 side, the left part 22*f* is made to have the constitution similar to the right parts 22*d* and 22*e*, that is, the duct 22 is constituted such that the left and right sides are symmetrical.

Further, the opening 22*b* of the longitudinal right part 22*e* is formed to have such a width that the pilot hoses 21 may be inserted easily. A front surface 22*g* is constituted by an inclined surface so that it can be extended along the guard cover front plate 9*e*. The lower opening 22*c* is formed to have the length L2 shorter than the width L1 of the duct so that the pilot hoses 21 and 27 may be gathered in the central portion and pulled out.

Figure 4A:
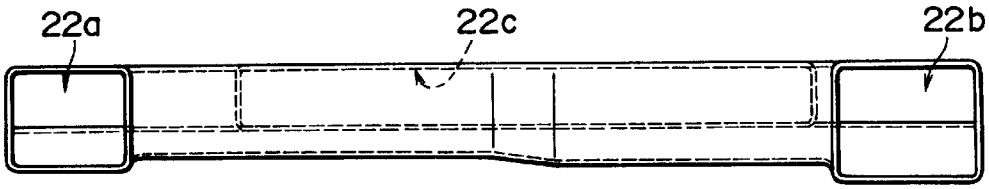
FIGS. 4(*a*), 4(*b*), 4(*c*) and 4(*d*) are a plan view, showing the constitution of a duct, a left end view, a front view, and a right end view, respectively.
Figure 4C:
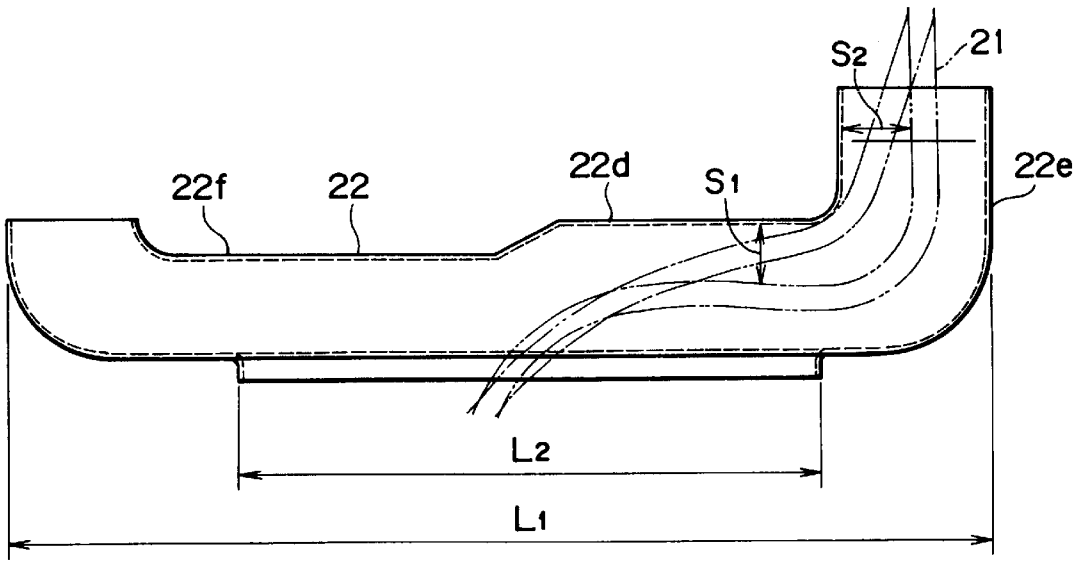
Figure 4D:
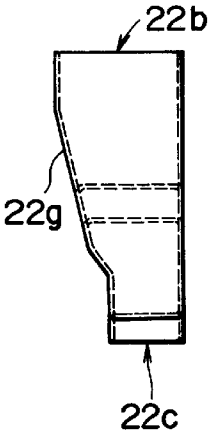
Figure 4B:
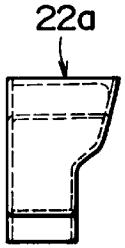
Figure 5:
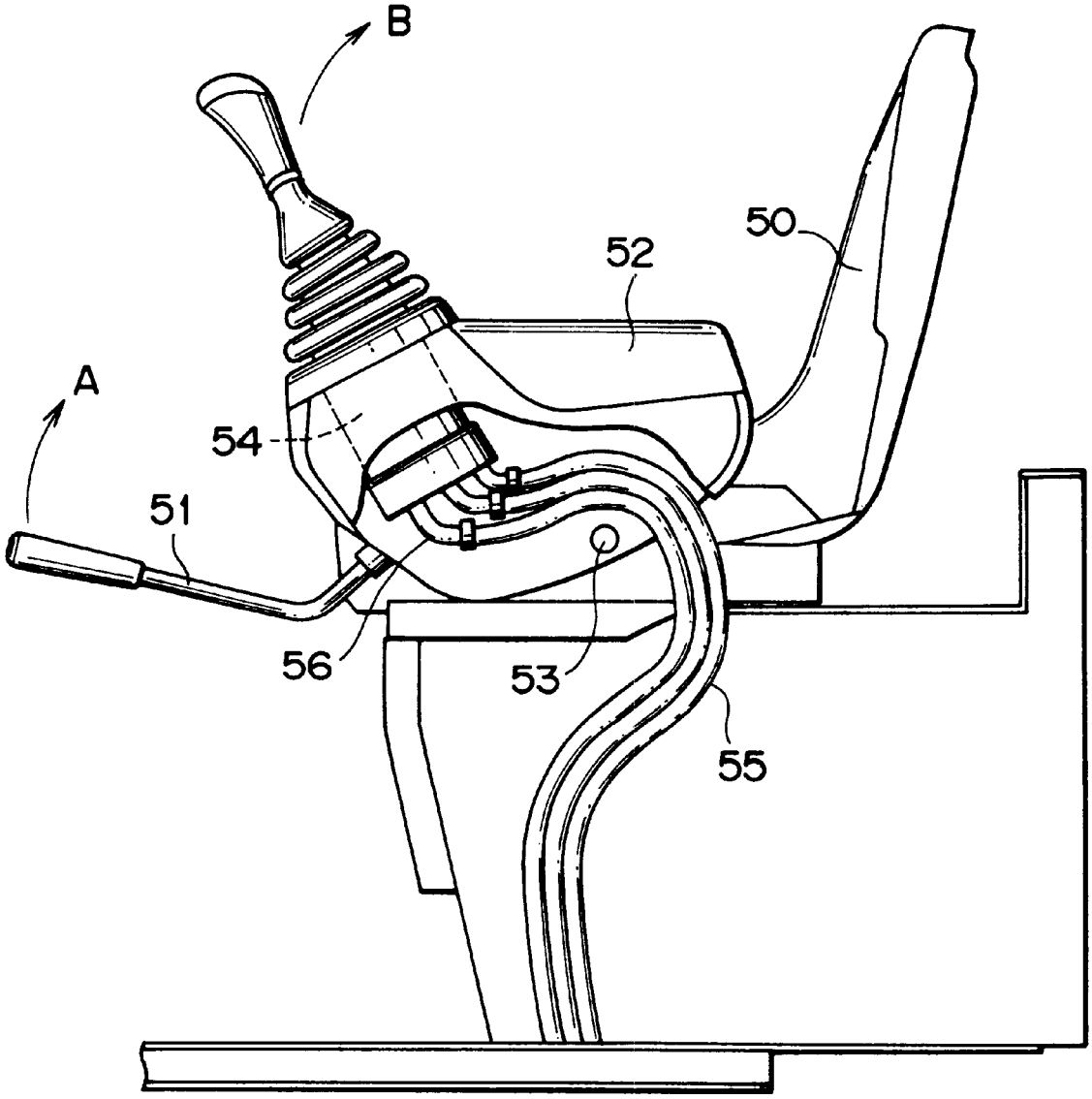
FIG. 5 PRIOR ART
FIG. 5 is a view corresponding to FIG. 2 showing an arrangement of pilot hoses in prior art.

In the pilot piping construction having the aforementioned constitution, when the operating lever 13 of the control box 14 is forced into the backward jump-up position (position E in the figure) or the forward jump-up position (position F in the figure) from the normal position (position D in the figure) to draw upward the pilot hoses 21 extending from the remote control valve 15, as shown in FIG. 3A, the pilot hoses 21 which will have been bent within the duct 22 are displaced into a linear form which eliminates a play so that the up and down movement is absorbed, as shown in FIG. 4C. When the operating lever 13 is returned to the normal position, the pilot hoses 21 are again returned to the bent state at the L-shaped portion of the duct.

Further, since the duct 22 is provided on the front side inside the guard cover 9, that is, a part which is free from interference with the hydraulic piping and the engine piping, the pilot hoses 21 can be moved around simply. Further, if the front surface of the guard cover 9 is constituted to be detachable, the maintenance of the pilot hoses 21 can be carried out easily.

While in the above-described embodiment, the system has been illustrated as the applied object, in which the remote control valve is operated by the operating lever, and the control valve is indirectly operated by the remote control valve, it is to be noted that the present invention is not limited thereto but the invention can be applied also to the system in which the control valve is directly operated by the operating lever.

Furthermore, the construction machine according to the present invention can be applied to not only the above-described hydraulic excavator but also the construction machine such as a crane.

We claim:

1. A construction machine comprising:

a maneuvering seat on which an operator sits;

a guard cover for supporting said maneuvering seat thereon;

a control box arranged on one side of said maneuvering seat, said control box having a control valve and an operating lever for operating said control valve, said control box being pivoted around a turning fulcrum;

hydraulic hoses which are connected to said control valve and are extended from said control box, said hydraulic hoses having a bent portion located externally of said control box, said bent portion being displaced when said control box is pivoted to absorb an up and down movement of said hydraulic hoses; and a duct provided within said guard cover, said hydraulic hoses being received within said duct, wherein a play space is formed vertically and horizontally within said duct, said duct having an L-shaped bent portion formed in said duct, which is configured to maintain the shape of said bent portion of said hydraulic hoses.

2. The construction machine according to claim 1, wherein said hydraulic hoses are positioned forward of said turning fulcrum of said control box.

3. The construction machine according to claim 1, wherein said duct is positioned below said maneuvering seat and is mounted along a guard cover front plate.

4. The construction machine according to claim 3, wherein the guard cover front plate is connected to a front edge portion of a top plate of the guard cover through a hinge.

5. The construction machine according to claim 3, wherein said duct is U-shaped, and hydraulic hoses extending from an other side of said maneuvering seat are received within said duct.

6. The construction machine according to claim 5, wherein said hydraulic hoses on the one side and said hydraulic hoses on the other side are gathered in a central portion of said duct, and pulled out of an opening formed in a lower central portion of said duct.

7. The construction machine according to claim 1, wherein a top plate of said guard cover is turned forward and opened about a front edge portion of said guard cover acting as a fulcrum, and also when said top plate turns, said bent portion is displaced to absorb the up and down movement of said hydraulic hoses.

* * * * *